US012806734B2

(12) United States Patent
Choi et al.

(10) Patent No.: US 12,806,734 B2
(45) Date of Patent: Nov. 24, 2026

(54) POLISHING HEAD AND SEGMENTATION TYPE HEAD MODULE OF A CHEMICAL MECHANICAL POLISHING APPARATUS

(71) Applicant: Samsung Electronics Co., Ltd., Suwon-si (KR)

(72) Inventors: Junyoung Choi, Suwon-si (KR); Wonuk Yoon, Suwon-si (KR); Jaemook Kang, Suwon-si (KR); Keonwoo Kim, Suwon-si (KR); Sungyong Park, Suwon-si (KR); Hoseop Choi, Suwon-si (KR); Seonmin Yun, Suwon-si (KR); Jitae Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 368 days.

(21) Appl. No.: 18/524,745

(22) Filed: Nov. 30, 2023

(65) Prior Publication Data

US 2024/0399532 A1 Dec. 5, 2024

(30) Foreign Application Priority Data

Jun. 2, 2023 (KR) ..... 10-2023-0071318

(51) Int. Cl.
*B24B 41/047* (2006.01)
*B24B 37/005* (2012.01)
(Continued)

(52) U.S. Cl.
CPC ..... *B24B 41/047* (2013.01); *B24B 37/005* (2013.01); *B24B 37/20* (2013.01); *B24B 37/30* (2013.01); *B24B 41/04* (2013.01)

(58) Field of Classification Search
None
See application file for complete search history.

(56) References Cited

U.S. PATENT DOCUMENTS 7,207,871 B1 * 4/2007 Zuniga ..... B24B 49/16 451/388
9,403,255 B2 8/2016 Fukushima et al.
(Continued)

FOREIGN PATENT DOCUMENTS

JP 6266493 B2 1/2018
JP 6447472 B2 12/2018
JP 7158223 B2 10/2022

*Primary Examiner* — Juan G Flores
(74) *Attorney, Agent, or Firm* — Wolf, Greenfield & Sacks, P.C.

(57) ABSTRACT

A polishing head of a CMP apparatus may include a head block, a distribution block and a segmentation type head module. The head block may configured to be positioned over a substrate. The distribution block may be rotatably connected to a lower surface of the head block with respect to a vertical direction. A plurality of pressure lines may be connected to the distribution block and configured to flow a working fluid therethrough. The segmentation type head module may be connected to the lower surface of the distribution block. The segmentation type head module may be configured to rotate with respect to the vertical direction together with the distribution block. The segmentation type head module may be configured to locally pressurize the substrate using the working fluid provided through the pressure lines.

17 Claims, 10 Drawing Sheets

(51) Int. Cl.

| | |
|---|---|
| ***B24B 37/20*** | (2012.01) |
| ***B24B 37/30*** | (2012.01) |
| ***B24B 41/04*** | (2006.01) |

(56) References Cited

U.S. PATENT DOCUMENTS

| | | | | |
|---|---|---|---|---|
| 9,550,269 | B2 | 1/2017 | Shiokawa et al. | |
| 9,962,805 | B2 | 5/2018 | Chang et al. | |
| 11,075,085 | B2 | 7/2021 | Nishitani et al. | |
| 11,511,389 | B2 * | 11/2022 | Akazawa | B24B 37/105 |
| 11,780,049 | B2 * | 10/2023 | Zuniga | B24B 37/005 451/364 |
| 2007/0082589 | A1 * | 4/2007 | Zuniga | B24B 37/30 451/288 |
| 2020/0094371 | A1 * | 3/2020 | Akazawa | B24B 37/105 |
| 2021/0402549 | A1 | 12/2021 | Zuniga et al. | |
| 2021/0402558 | A1 * | 12/2021 | Zuniga | B24B 37/005 |
| 2022/0009053 | A1 | 1/2022 | Swedek | |
| 2022/0143779 | A1 | 5/2022 | Nagengast et al. | |
| 2022/0258301 | A1 | 8/2022 | Zuniga et al. | |

* cited by examiner

POLISHING HEAD AND SEGMENTATION TYPE HEAD MODULE OF A CHEMICAL MECHANICAL POLISHING APPARATUS

CROSS-RELATED APPLICATION

This application claims priority under 35 USC § 119 to Korean Patent Application No. 10-2023-0071318, filed on Jun. 2, 2023, in the Korean Intellectual Property Office (KIPO), the contents of which are herein incorporated by reference in their entirety.

BACKGROUND

1. Field

Example embodiments relate to a polishing head and a segmentation type head module of a chemical mechanical polishing apparatus. More particularly, example embodiments relate to a polishing head of a chemical mechanical polishing apparatus configured to hold a semiconductor substrate and a segmentation type head module of a chemical mechanical polishing apparatus.

2. Description of the Related Art

Generally, a layer on a semiconductor substrate may be planarized using a chemical mechanical polishing (CMP) apparatus. The CMP apparatus may include a polishing head, a platen, a polishing pad, a slurry arm, etc. The polishing head may hold the semiconductor substrate. The platen may be arranged under the polishing head. The polishing pad may be arranged on an upper surface of the platen to polish the semiconductor substrate. The slurry arm may supply slurry to the polishing pad.

The polishing head may apply a uniform pressure to the semiconductor substrate. That is, the polishing head may not apply local pressures to regions of the semiconductor substrate. Thus, after a CMP process, the regions of the semiconductor substrate may have different thicknesses. As a result, the layer on the semiconductor substrate may have non-uniform thicknesses. The non-uniform thicknesses of the layer may cause an error of a following process.

SUMMARY

Example embodiments provide a polishing head of a chemical mechanical polishing (CMP) apparatus that may be capable of selectively applying desired pressures to regions of a semiconductor substrate.

Example embodiments also provide a segmentation type head module of a CMP apparatus.

According to example embodiments, there may be provided a polishing head of a CMP apparatus. The polishing head may include a head block, a distribution block and a segmentation type head module. The head block may be configured to be positioned over a substrate. The distribution block may be rotatably connected to a lower surface of the head block with respect to a vertical direction. A plurality of pressure lines t may be connected to the distribution block and configured to provide a working fluid flowing therethrough. The segmentation type head module may be connected to the lower surface of the distribution block. The segmentation type head module may be configured to rotate with respect to the vertical direction together with the distribution block. The segmentation type head module may be configured to locally pressurize the substrate using the working fluid provided through the plurality of pressure lines.

According to example embodiments, there may be provided a polishing head of a CMP apparatus. The polishing head may include a head block, a distribution block, a main actuator, a head module and a control module. The head block may be configured to be positioned over a substrate. The distribution block may be rotatably connected to a lower surface of the head block with respect to a vertical direction. A plurality of pressure lines may be connected to the distribution block and configured to flow a working fluid therethrough. The main actuator may be configured to rotate the distribution block with respect to the vertical direction. The head module may be connected to the lower surface of the distribution block. The head module may be configured to rotate with respect to the vertical direction together with the distribution block. The head module may be configured to locally pressurize the substrate using the working fluid provided through the pressure lines. The control module may be configured to independently control pressures of the working fluid provided to the head module through the pressure lines.

According to example embodiments, there may be provided a segmentation type head module of a CMP apparatus. The segmentation type head module may include a gimbal shaft and a plurality of segmentation type heads. The gimbal shaft may be configured to receive a rotary force for rotating a substrate with respect to a vertical direction. The segmentation type head module may be connected to the gimbal shaft. The segmentation type head module may be configured to be independently moved with respect to the gimbal shaft along the vertical direction.

According to example embodiments, the segmentation type head module may locally pressurize the substrate using the working fluid provided through the pressure lines so that desired pressures may be applied to regions of the substrate. Thus, a layer on the substrate after a CMP process may be provided with a uniform thickness. As a result, an error in a following process may not be generated.

BRIEF DESCRIPTION OF THE DRAWINGS

Example embodiments will be more clearly understood from the following detailed description taken in conjunction with the accompanying drawings.

FIG. 1 is a perspective view illustrating a CMP apparatus in accordance with example embodiments;

FIG. 2 is an enlarged perspective view illustrating a polishing head of the apparatus in FIG. 1;

FIG. 3 is a cross-sectional view illustrating the polishing head in FIG. 2;

FIG. 4 is a cross-sectional view illustrating an actuator of the polishing head in FIG. 3;

FIG. 5 is a perspective view illustrating a segmentation type head of the polishing head in FIG. 3;

FIG. 6 is a cross-sectional view illustrating the segmentation type head in FIG. 5;

FIG. 7 is a cross-sectional view illustrating an independent operation of the segmentation type head in FIG. 6;

FIGS. 8 to 13 are perspective views illustrating segmentation type heads in accordance with example embodiments;

FIG. 14 is a flow chart illustrating a method of controlling segmentation type heads of the polishing head in FIG. 3; and FIG. 15 is a cross-sectional view illustrating a polishing head of a CMP apparatus in accordance with example embodiments.

DETAILED DESCRIPTION

Hereinafter, example embodiments will be explained in detail with reference to the accompanying drawings.

Figure 1:
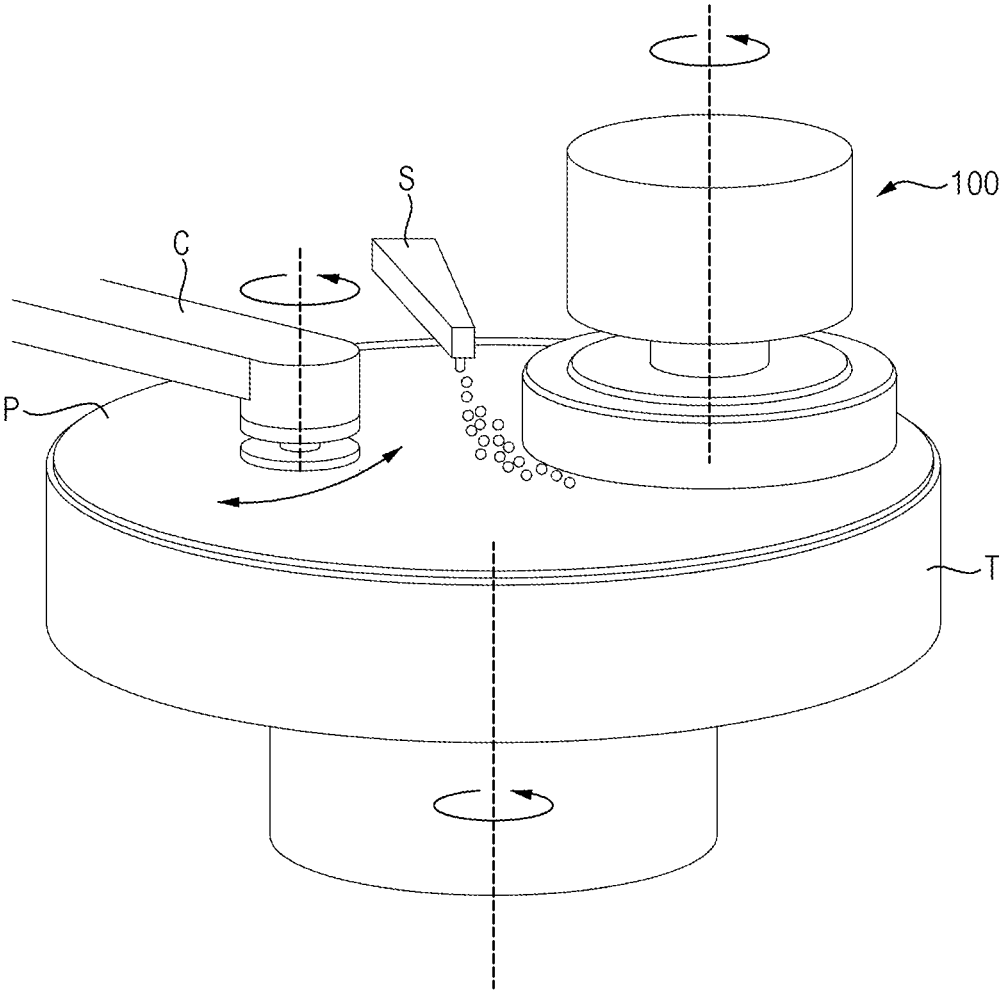
FIGS. 1 to 15 represent non-limiting, example embodiments as described herein.
Figure 2:
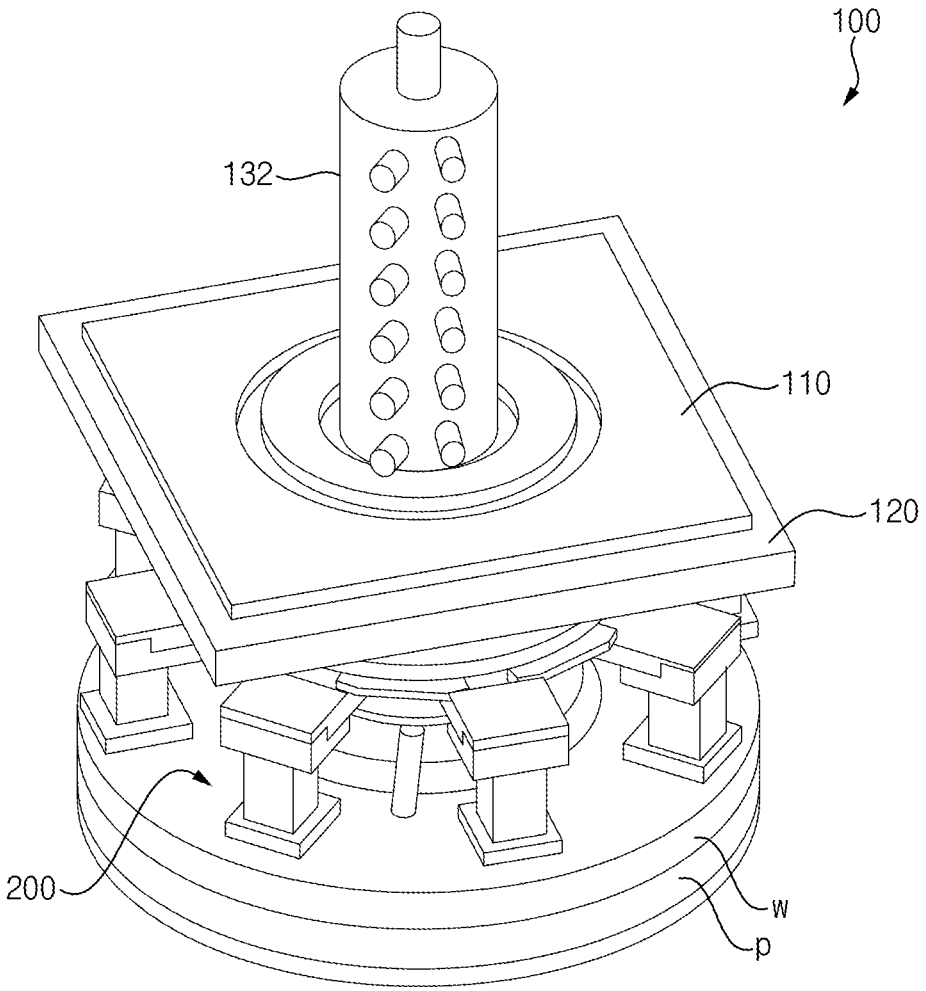
Figure 3:
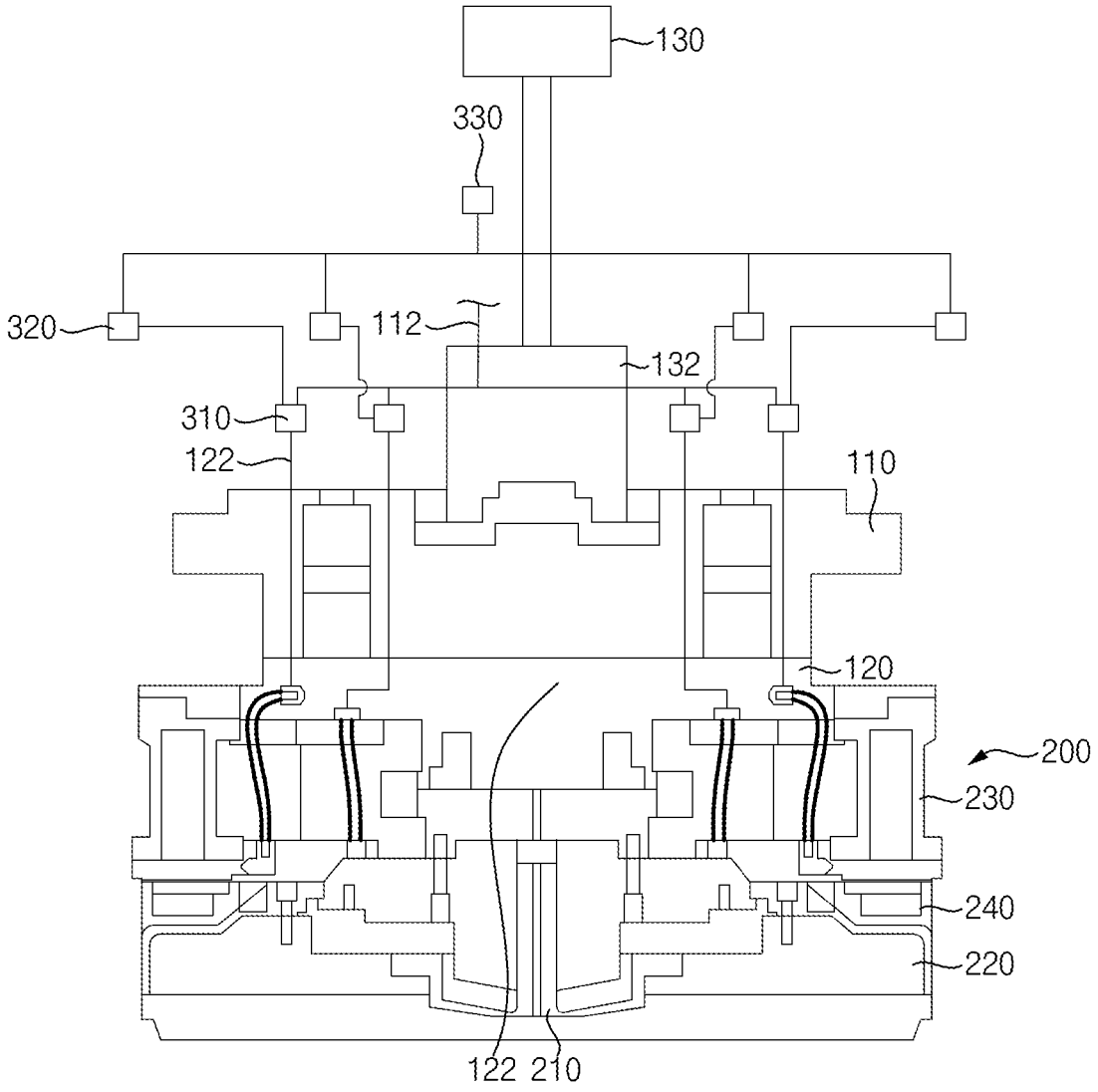
Figure 4:
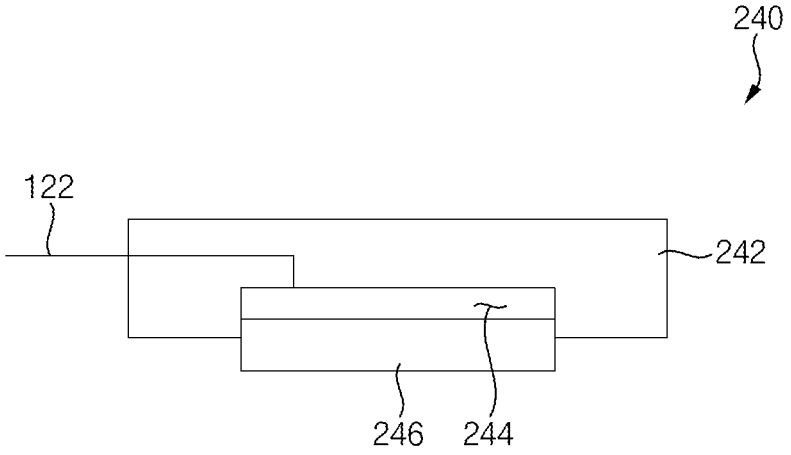
Figure 5:
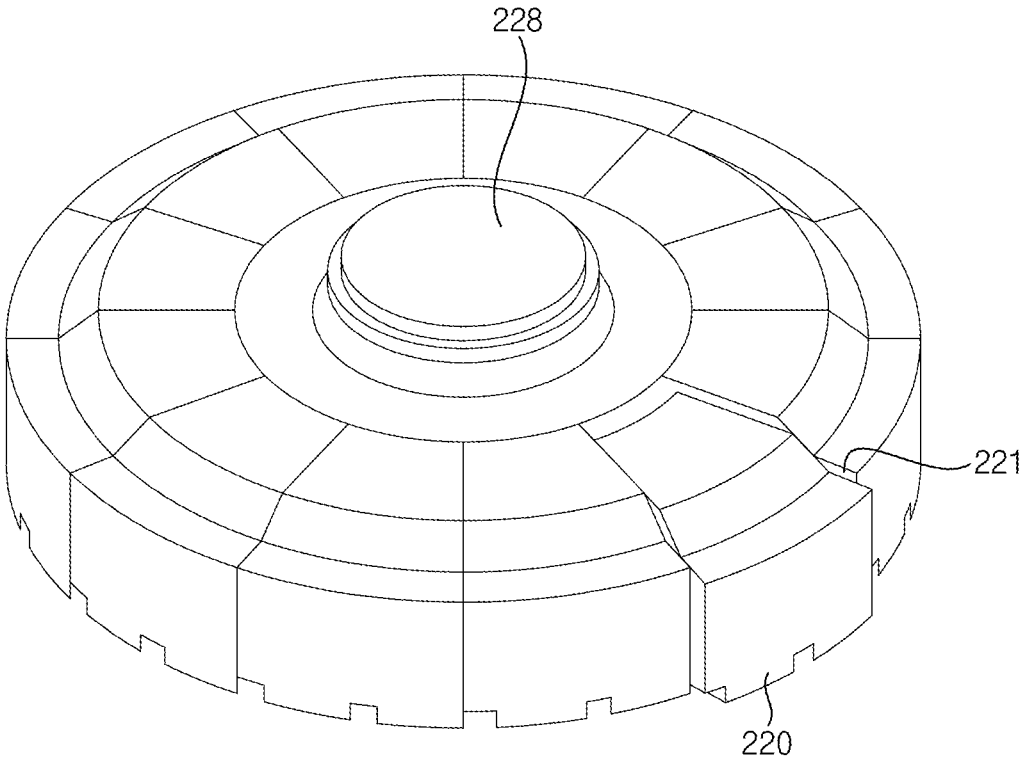
Figure 6:
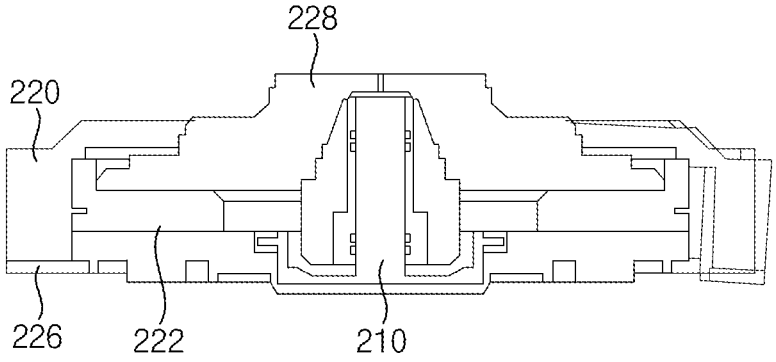
Figure 7:
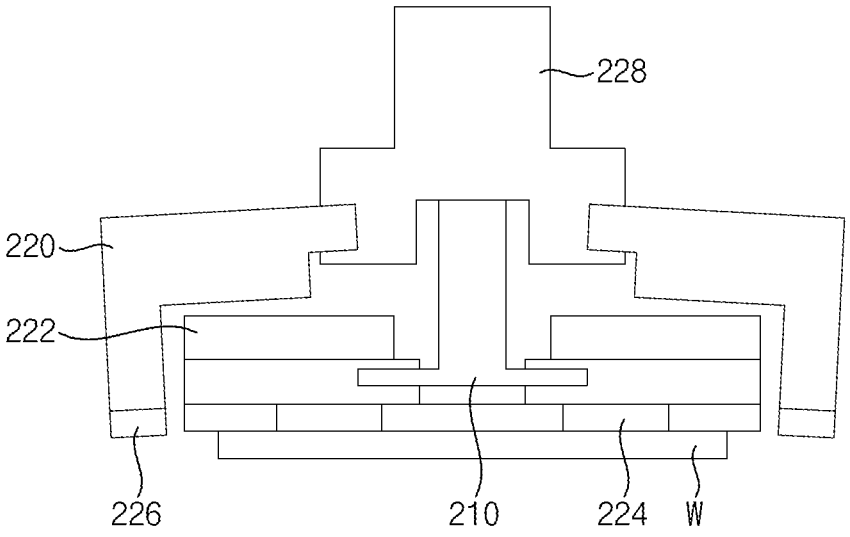

FIG. 1 is a perspective view illustrating a CMP apparatus in accordance with example embodiments. FIG. 2 is an enlarged perspective view illustrating a polishing head of the apparatus in FIG. 1 and FIG. 3 is a cross-sectional view illustrating the polishing head in FIG. 2. FIG. 4 is a cross-sectional view illustrating an actuator of the polishing head in FIG. 3. FIG. 5 is a perspective view illustrating a segmentation type head of the polishing head in FIG. 3, FIG. 6 is a cross-sectional view illustrating the segmentation type head in FIG. 5 and FIG. 7 is a cross-sectional view illustrating an independent operation of the segmentation type head in FIG. 6.

Referring to FIG. 1, a CMP apparatus of example embodiments may include a polishing head 100, a platen T, a polishing pad P, a slurry arm S and a conditioner C.

The platen T may be arranged under the polishing head 100. The polishing pad P may be arranged on an upper surface of the platen T. The platen T may be rotated with respect to a vertical direction. Thus, the polishing pad P may also be rotated with respect to the vertical direction together with the platen T. The polishing pad P may chemically mechanically polish a layer on a substrate W (see FIG. 2), for example, a metal layer using slurry provided from the slurry arm S. The slurry may include an oxidizing agent.

The conditioner C may be arranged over the platen T. The conditioner C may include a conditioning disk configured to condition the polishing pad P.

The polishing head 100 may be arranged over the platen T. The polishing head 100 may hold the substrate W. The substrate W may be fixed to a lower surface of the polishing head 100. The polishing head 100 may fix the substrate W using vacuum. The polishing head 100 may be rotated with respect to the vertical direction.

As described in detail in FIG. 7 below, a membrane 224 may be arranged on a central portion of the lower surface of the polishing head 100. A retainer ring 226 may be arranged on an edge portion of the lower surface of the polishing head 100 to surround or extend around the membrane 224. The retainer ring 226 may support a circumferential surface of the substrate W in a CMP process.

Referring to FIGS. 2 and 3, the polishing head 100 of example embodiments may include a head block 110, a distribution block 120, a main actuator 130, a segmentation type head module 200 and a control module 300.

The head block 110 may include a vacuum line configured to receive the vacuum for holding the substrate W. A plurality of pressure lines 122 may be connected to the head block 110. A working fluid may be provided to the pressure lines 122. The pressure lines 122 may be branched from a main pressure line 112. The pressure lines 122 may be extend radially from the distribution block 120. Thus, ends of the pressure lines 122 may be positioned in an edge portion of the distribution block 120. The ends of the pressure lines 122 may be exposed through a lower surface of the edge portion of the distribution block 120. In example embodiments, the ends of the pressure lines 122 may be spaced apart from each other by a uniform gap on the lower surface of the edge portion of the distribution block 120, but embodiments of the inventive concept are not limited thereto. The working fluid may include air, but embodiments of the inventive concept are not limited thereto.

The distribution block 120 may be rotatably connected to a lower surface of the head block 110 with respect to the vertical direction. The distribution block 120 may have a diameter longer than a diameter of the head block 110. Thus, the edge portion of the distribution block 120 may be protruded from an outer circumferential surface of the head block 110 along a radial direction of the head block 110.

The main actuator 130 may be arranged over the head block 110, but embodiments of the inventive concept are not limited thereto. The main actuator 130 may be connected to the head block 110 via a rotary union 132. The main actuator 130 may rotate the distribution block 120 with respect to the vertical direction. The main actuator 130 may include a motor, but embodiments of the inventive concept are not limited thereto.

The segmentation type head module 200 may be connected to the lower surface of the distribution block 120. Thus, the segmentation type head module 200 may be rotated with respect to the vertical direction together with the distribution block 120. Further, the segmentation type head module 200 may locally pressurize the substrate W using the working fluid provided through the pressure lines 122.

The segmentation type head module 200 may include a core 228 (see FIG. 5), a gimbal shaft 210, a plurality of segmentation type heads 220, a plurality of supports 230 and a plurality of actuators 240. The core 228 may be connected to the central portion of the lower surface of the distribution block 120.

The gimbal shaft 210 may be connected to the core 228 as shown in FIG. 7. Thus, the gimbal shaft 210 may be rotated with respect to the vertical direction together with the distribution block 120. That is, the rotary force for rotating the distribution block 120 with respect to the vertical direction may be transferred to the gimbal shaft 210. A carrier 222 may be connected to an outer circumferential surface of the gimbal shaft 210. The membrane 224 may be arranged on a lower surface of the carrier 222.

The segmentation type heads 220 may be positioned around (e.g., to surround) the gimbal shaft 210. Particularly, the segmentation type heads 220 may surround the core 228 for supporting the gimbal shaft 210. Further, the segmentation type heads 220 may not be connected to the core 228. Thus, a gap may be formed between the segmentation type heads 220 and the carrier 222 so that the segmentation type heads 220 may be operated independently upon the carrier 222. That is, the segmentation type heads 220 may be driven independently upon the gimbal shaft 210. Thus, the segmentation type heads 220 may be moved independently with respect to the gimbal shaft 210 along the vertical direction.

The segmentation type heads 220 may be connected to the distribution block 120. Particularly, the segmentation type heads 220 may be connected to the core 228 connected with the distribution block 120. The segmentation type heads 220 may be relatively moved independently with respect to the distribution block 120, i.e., the core 228 along the vertical direction. The independently driven segmentation type heads 220 may locally pressurize the regions of the substrate W.

The supports 230 may be arranged on the lower surface of the distribution block 120. Particularly, the supports 230 may be arranged on the lower surface of the edge portion of the distribution block 120. The supports 230 may support the actuators 240. That is, the actuators 240 may be fixed to the supports 230.

Each of the pressure lines 122 may be connected to the actuators 240, respectively. Each of the actuators 240 may be arranged over each of the segmentation type heads 220. The actuators 240 may independently drive the segmentation type heads 220 using the working fluid provided through the pressure lines 122.

Referring to FIG. 4, the actuator 240 may include a housing 242 and a pressurizing member 246. The pressure line 122 may be connected to the housing 242. The housing 242 may include a pressure chamber 244 configured to receive the working fluid provided through the pressure line 122. The pressure chamber 244 may be formed at a lower surface of the housing 242.

The pressurizing member 246 may be arranged at a lower surface of the pressure chamber 244. The pressurizing member 246 may include a flexible material expanded by a pressure of the working fluid in the pressure chamber 244. The expanded pressuring member 246 may pressurize the segmentation type head 220. Thus, different pressures may be applied to the segmentation type heads 220 in accordance with the pressures in the pressure chambers 244. The pressure in the pressure chamber 244 may be transferred to the retainer ring 226 through the segmentation type head 220. As a result, the pressure transferred to the retainer ring 226 may be applied to the polishing pad P. A repulsive force from the polishing pad P may be applied to the substrate W to locally pressurize the regions of the substrate W.

Alternatively, the actuator 240 may include a cylinder having a piston driven by a pneumatic pressure. Different pressures in accordance with pressures applied to the piston may be applied to the segmentation type heads 220.

Referring to FIGS. 5 to 7, the segmentation type heads 220 may be arranged around the core 228. Particularly, the segmentation type heads 220 may be arranged in a radial direction of the gimbal shaft 210. The segmentation type heads 220 may be spaced apart from each other by a uniform gap. Thus, the segmentation type heads 220 may have substantially the same shape.

The segmentation type heads 220 may be formed by cutting a conventional integral head along the radial direction. Each of the segmentation type heads 220 may be connected to only the outer circumferential surface of the core 228 and not connected to the carrier 222. In example embodiments, the segmentation type head 220 may include a resilient member. For example, the segmentation type head 220 may include a leaf spring, but embodiments of the inventive concept are not limited thereto. The segmentation type heads 220 may be moved relatively independently upon the core 228 along the vertical direction. Thus, each of the actuators 240 may press each of the segmentation type heads 220 to locally pressurize the substrate W by the segmentation type heads 220.

Therefore, the retainer ring 226 on the lower surface of the segmentation type heads 220 may be spaced apart from the carrier 222 so that the retainer ring 226 may also be independently operated similarly to the segmentation type head 220.

Additionally, a sealing member 221 may be interposed between the segmentation type heads 220. The sealing member 21 may prevent material used or generated in the CMP process from infiltrating into the polishing head 100.

FIGS. 8 to 13 are perspective views illustrating segmentation type heads in accordance with example embodiments.

Figure 8:
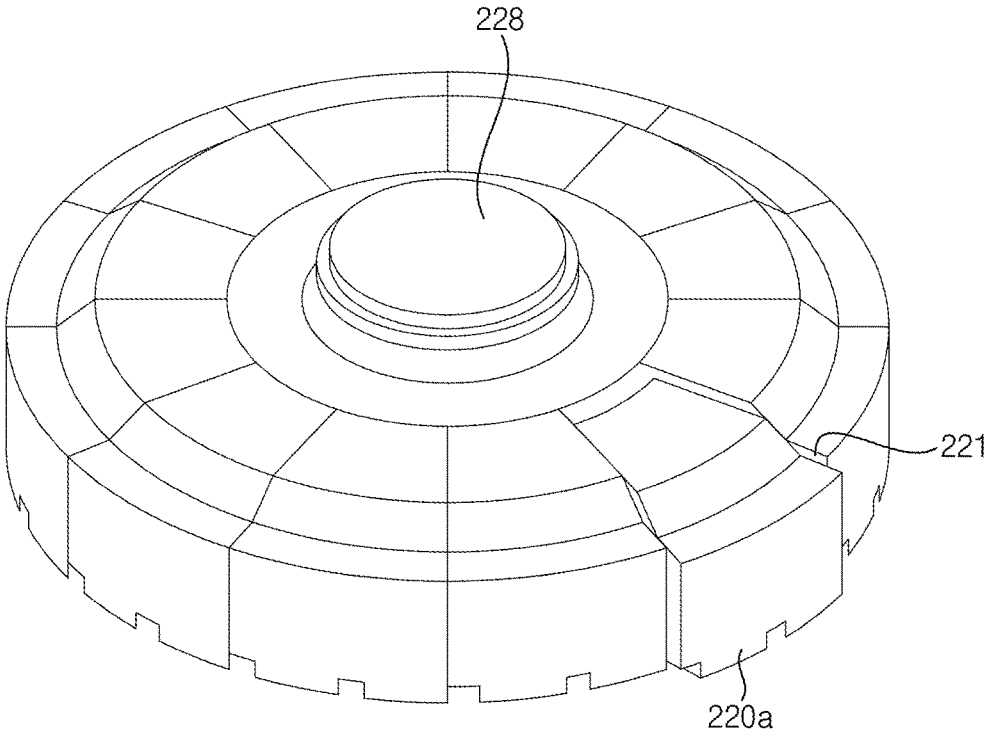

Referring to FIG. 8, a segmentation type head 220*a* of example embodiments may have a cantilever shape connected to the outer circumferential surface of the core 228. The cantilever-shaped segmentation type head 220*a* may include a resilient material, but embodiments of the inventive concept are not limited thereto.

Figure 9:
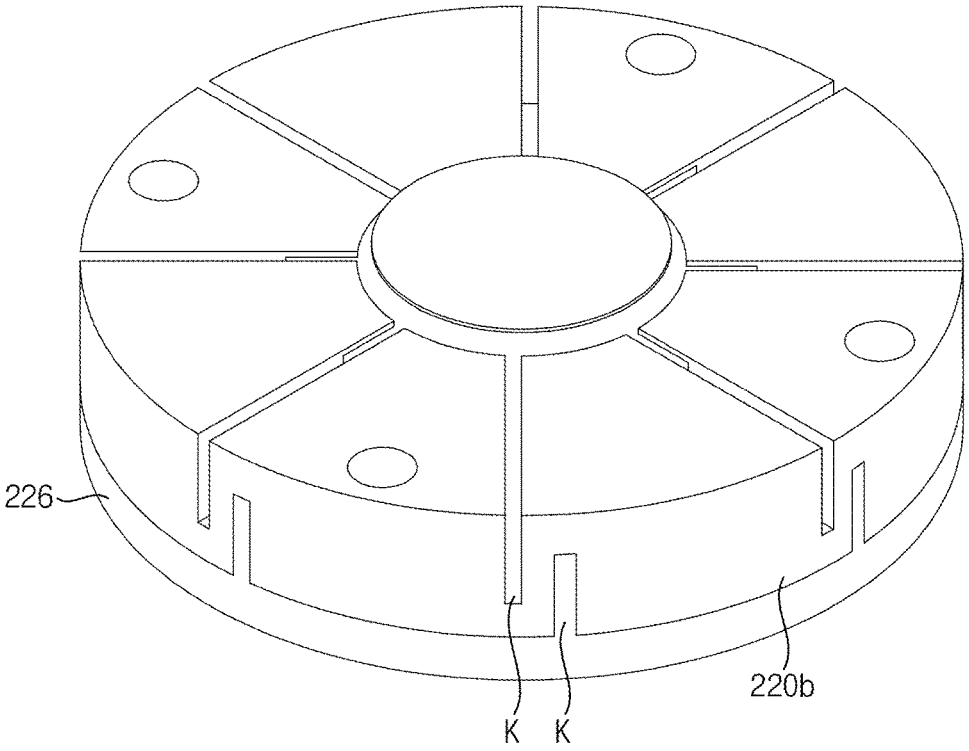

Referring to FIG. 9, a segmentation type head 220*b* of example embodiments may be formed by at least one kerf K formed at the conventional integral head along the radial direction. That is, the kerf K may be positioned between the segmentation type heads 220*b*.

In example embodiments, the kerf K may be formed on an upper surface and a lower surface of the segmentation type head 220*b*. Further, the kerf K may be extended from an outer circumferential surface to an inner circumferential surface in the segmentation type head 220*b*.

Figure 10:
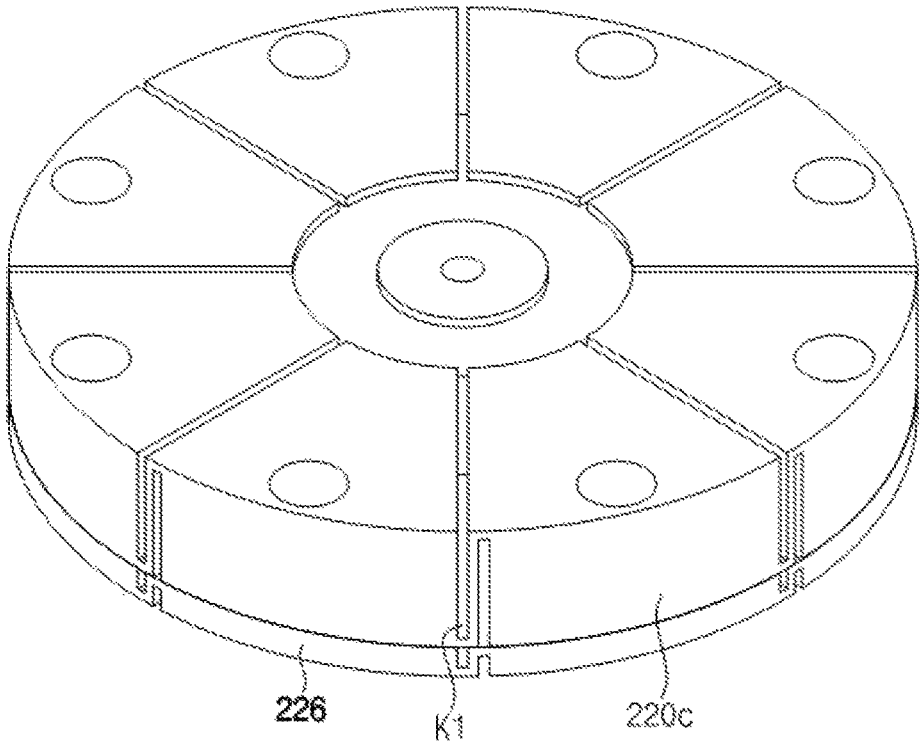

Referring to FIG. 10, a segmentation type head 220*c* of example embodiments may include a kerf K1 extended to the retainer ring 226. Thus, the retainer ring 226 may be divided into a plurality of rings similarly to the segmentation type head 220*c*.

Figure 11:
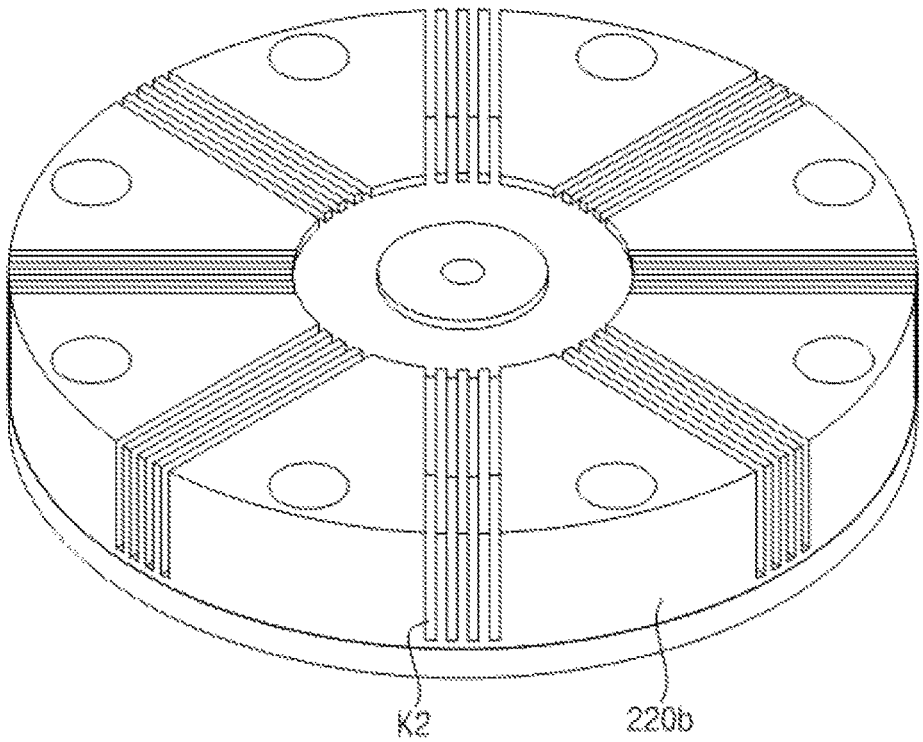

Referring to FIG. 11, a kerf K2 of example embodiments may be formed on only an upper surface of a segmentation type head 220*d*. Alternatively, the kerf K2 may be formed on only a lower surface of the segmentation type head 220*d*.

Figure 12:
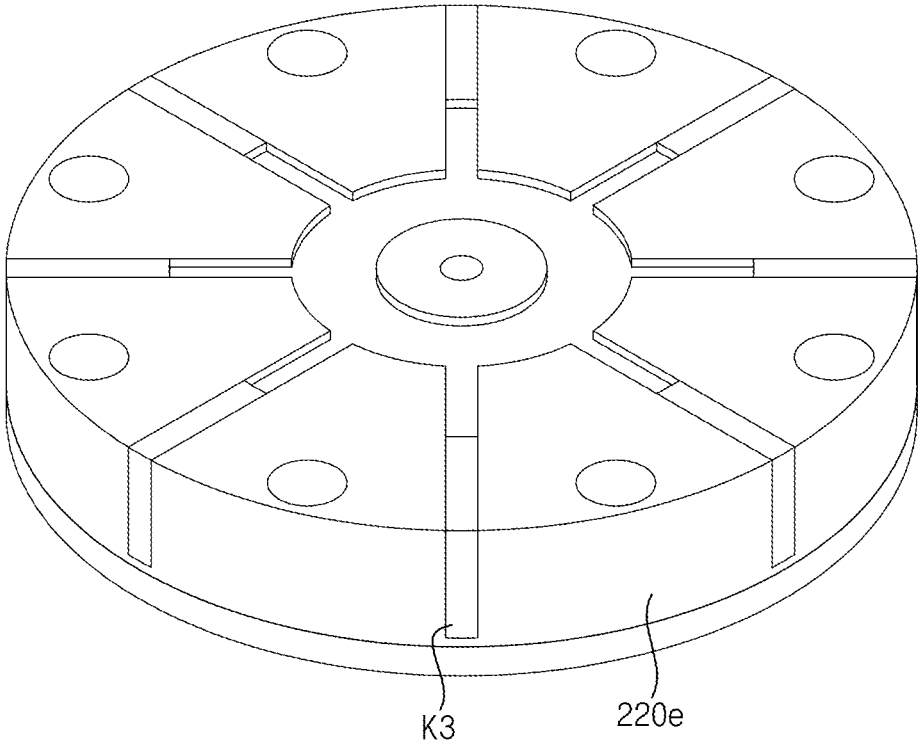

Referring to FIG. 12, a kerf K3 of example embodiments may be extended from an outer circumferential surface of a segmentation type head 220*e* along the radial direction. However, the kerf K3 may not be extended to an inner circumferential surface of the segmentation type head 220*e*.

Figure 13:
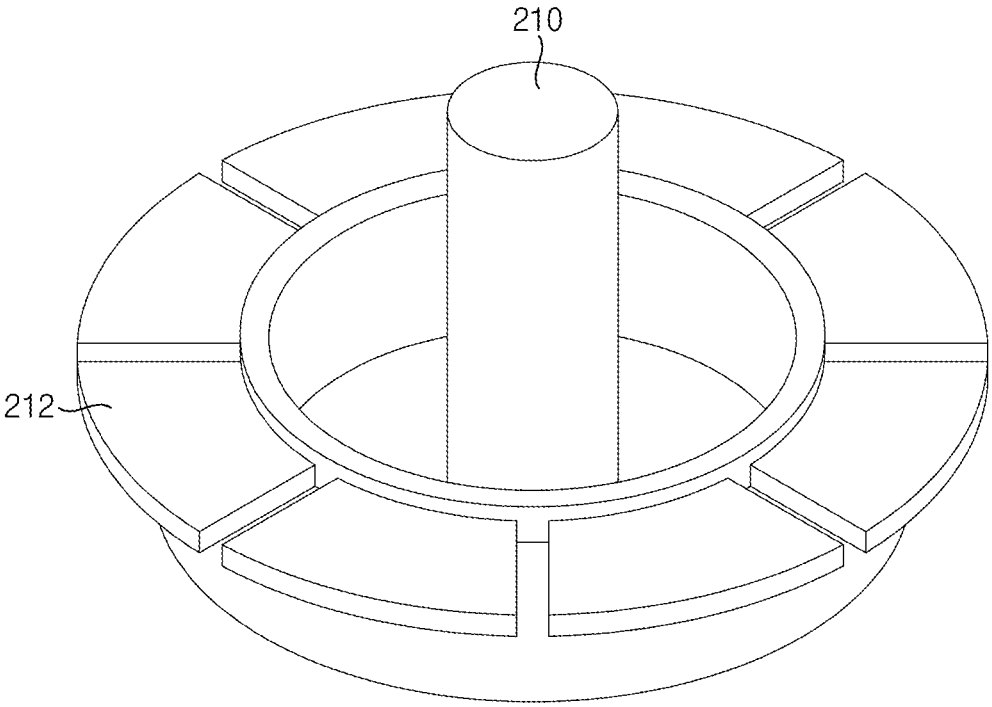

Referring to FIG. 13, the gimbal shaft 210 may be cut along the radial direction to form a plurality of gimbal portions 212. Each of the segmentation type heads 220 may be connected to the gimbal portions 212, respectively.

As mentioned above, because the segmentation type heads 220 may have the substantially the same shape, the lower surfaces of the segmentation type heads 220 making contact with the substrate W, i.e., pressurizing surfaces of the segmentation type heads 220 may also have substantially the same area. Thus, when a same pressure may be provided to the actuators 240, the segmentation type heads 220 having the same pressurizing surfaces may apply the same pressure to the regions of the substrate W. Therefore, the pressures applied to the regions of the substrate W from the segmentation type heads 220 may be precisely controlled by controlling the pressures provided to the actuators 240.

Referring again to FIG. 3, the control module 300 may include a plurality of pressure control valves 310, a plurality of controllers 320 and a main controller 330.

The pressure control valves 310 may be installed on the pressure lines 122. The pressure control valves 310 may independently control fluxes of the working fluids flowing through the pressure lines 122.

The controllers 320 may independently control operations of the pressure control valves 310. Thus, the fluxes of the working fluids provided to the actuators 240 may be independently controlled using the controllers 320.

The main controller 330 may totally control the operations of the controllers 320. The main controller 330 may control operations of the CMP apparatus.

Figure 14:
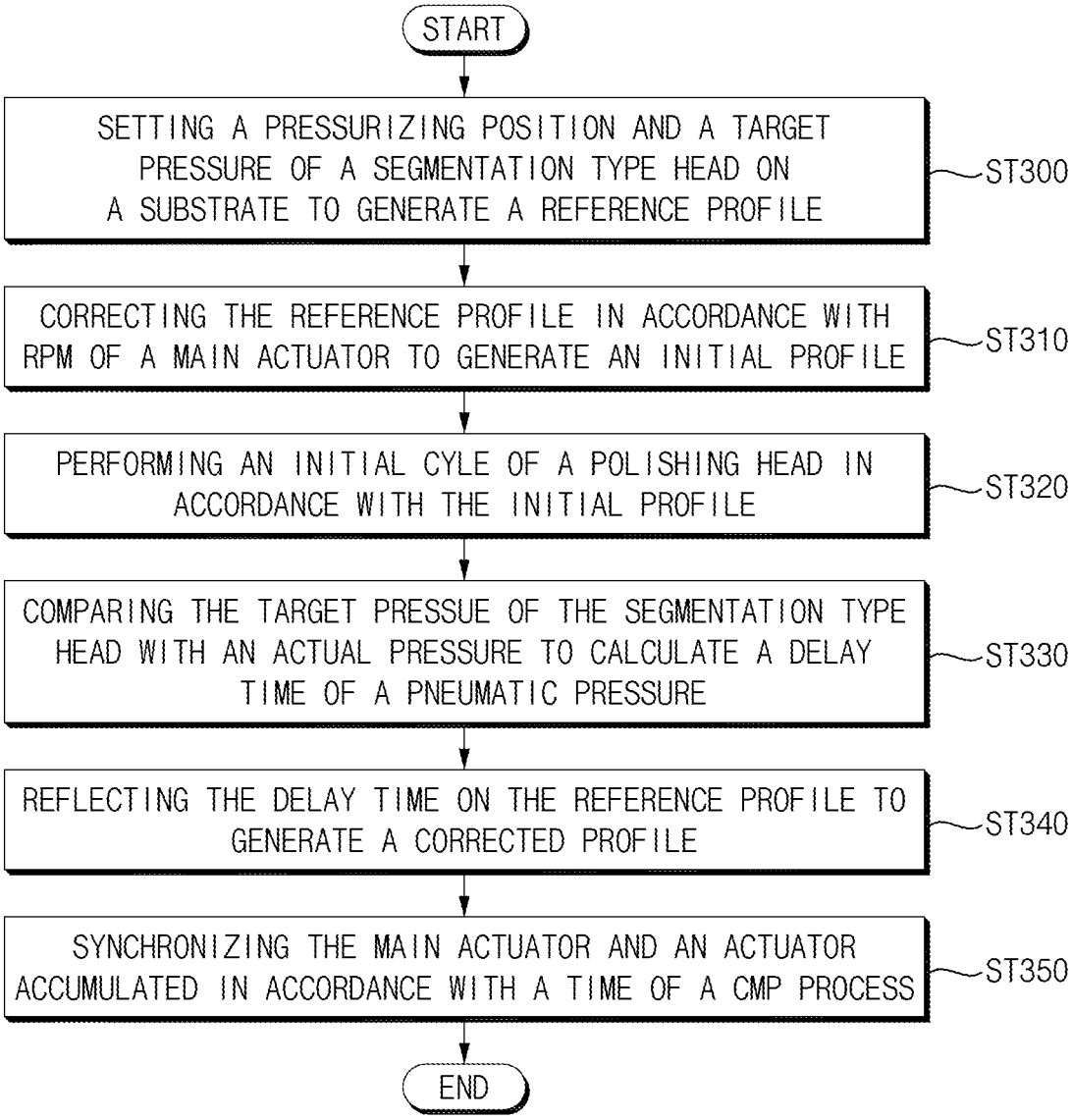

FIG. 14 is a flow chart illustrating a method of controlling segmentation type heads of the polishing head in FIG. 3.

Referring to FIGS. 3 and 14, in step ST300, a pressurizing position and a target pressure of the segmentation type head 220 may be set on the substrate W to generate a reference profile.

In step ST310, the reference profile may be corrected in accordance with an RPM of the main actuator 240 to generate an initial profile.

In step ST320, an initial cycle of the polishing head may be performed in accordance with the initial profile. That is, a CMP process may be performed once.

In step ST330, the target pressure of the segmentation type head 220 may be compared with an actual pressure to calculate a delay time of a pneumatic pressure. For example, the delay time may be estimated among cross relation values between a command and a follow signal in a reference window.

In step ST340, the delay time of the pneumatic pressure may be reflected on the reference profile to generate a corrected profile.

In step ST350, the main actuator 130 and the actuator 240 accumulated in accordance with a time of the CMP process may be synchronized with each other. For example, an actual rotation period of the actuator 240 may be detected to calculate a difference between the pressurizing position and an actual pressurizing position of the segmentation type head 220 on the corrected profile. The calculated difference may be applied to the corrected profile to update the corrected profile.

Figure 15:
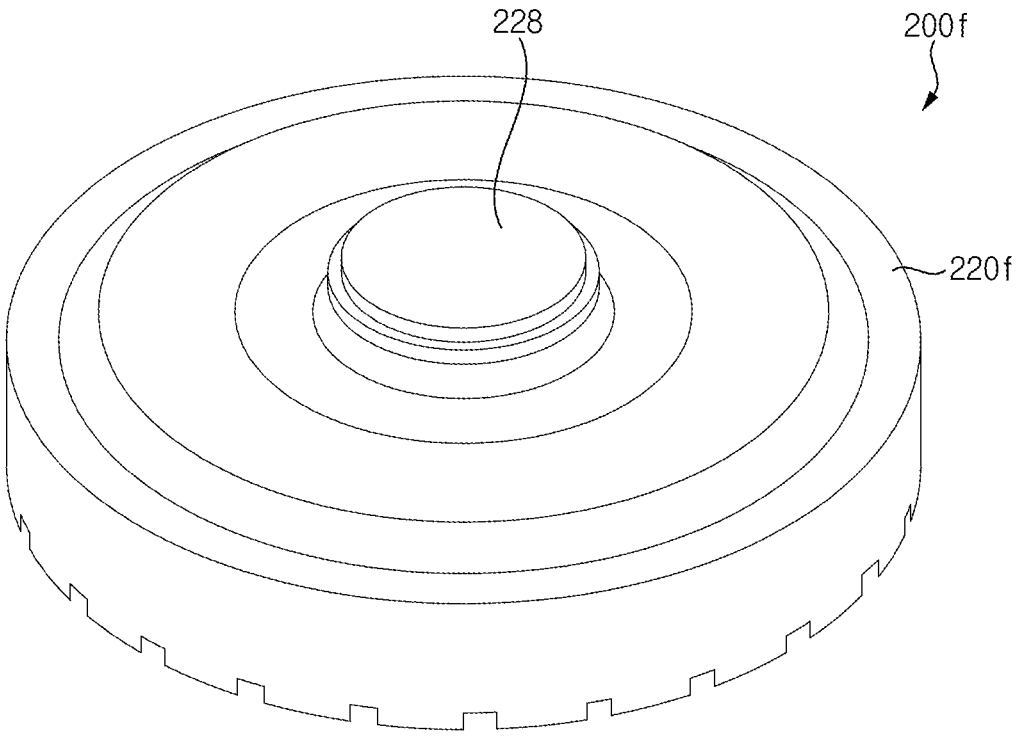

FIG. 15 is a cross-sectional view illustrating a polishing head of a CMP apparatus in accordance with example embodiments.

A polishing head 200*f* of example embodiments may include elements substantially the same as those of the polishing head 100 in FIG. 5 except for a shape of a head. Thus, the same reference numerals may refer to the same elements and any further illustrations with respect to the same elements may be omitted herein for brevity.

Referring to FIG. 15, the polishing head 200*f* of example embodiments may include an integral head 220*f*. That is, the polishing head 200*f* may be one body. Thus, the integral head 220*f* may not have the gap in FIG. 5.

The integral head 220*f* may be connected to the distribution block 120. The integral head 220*f* may be relatively moved independently upon the distribution block 120 along the vertical direction. Particularly, the integral head 220*f* may be connected to the outer circumferential surface of the core 228, not the carrier 222. The integral head 220*f* may be moved independently upon the core 228 along the vertical direction. Thus, each of the actuators 240 may locally press an upper surface of the integral head 220*f* to locally pressurize the regions of the substrate W by the integral head 220*f*.

According to example embodiments, the segmentation type head module may locally pressurize the substrate using the working fluid provided through the pressure lines so that desired pressures may be applied to regions of the substrate. Thus, a layer on the substrate after a CMP process may be provided with a uniform thickness. As a result, an error in a following process may not be generated.

The foregoing is illustrative of example embodiments and is not to be construed as limiting thereof. Although a few example embodiments have been described, those skilled in the art will readily appreciate that many modifications are possible in the example embodiments without droplet departing from the novel teachings and advantages of the present invention. Accordingly, all such modifications are intended to be included within the scope of the present invention as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A polishing head of a chemical mechanical polishing (CMP) apparatus comprising:

a head block configured to be positioned over a substrate;

a distribution block rotatably connected to a lower surface of the head block with respect to a vertical direction, the distribution block including a plurality of pressure lines configured to provide a working fluid flowing therethrough; and a segmentation type head module connected to the lower surface of the distribution block and configured to rotate with respect to the vertical direction together with the distribution block, the segmentation type head module configured to locally pressurize the substrate using the working fluid provided through the plurality of pressure lines, wherein the segmentation type head module comprises:

a gimbal shaft connected to a central portion of the lower surface of the distribution block;

a plurality of segmentation type heads around the gimbal shaft and connected to the distribution block, the plurality of segmentation type heads configured to be moved independently with respect to the distribution block along the vertical direction;

a sealing member between ones of the plurality of segmentation type heads; and a plurality of actuators connected to the plurality of pressure lines and configured to independently operate the plurality of segmentation type heads, and wherein the plurality of segmentation type heads are spaced apart from each other by a uniform gap along a circumferential line of the gimbal shaft.

2. The polishing head of the CMP apparatus of claim 1, wherein the plurality of segmentation type heads have a cantilever shape.

3. The polishing head of the CMP apparatus of claim 1, wherein the plurality of segmentation type heads comprise resilient members.

4. The polishing head of the CMP apparatus of claim 1, wherein at least one kerf is between the plurality of segmentation type heads along a radial direction of the gimbal shaft.

5. The polishing head of the CMP apparatus of claim 4, wherein the at least one kerf is extended to a retainer ring configured to extend around the plurality of segmentation type heads.

6. The polishing head of the CMP apparatus of claim 1, wherein the gimbal shaft comprises a plurality of gimbal portions independently connected to the plurality of segmentation type heads.

7. The polishing head of the CMP apparatus of claim 1, wherein each of the plurality of actuators comprises:

a housing including a pressure chamber connected to each of the plurality of pressure lines to receive the working fluid; and a flexible member selectively expanded by a pressure of the working fluid in the pressure chamber to pressurize the substrate.

8. The polishing head of the CMP apparatus of claim 1, wherein the segmentation type head module further comprises a plurality of supports on the lower surface of the distribution block and configured to support the plurality of actuators.

9. The polishing head of the CMP apparatus of claim 1, further comprising a controller configured to independently control operations of the segmentation type head module.

10. The polishing head of the CMP apparatus of claim 9, wherein the controller comprises:

a plurality of pressure control valves on the plurality of pressure lines; and a plurality of controllers configured to independently control operations of the plurality of pressure control valves.

11. The polishing head of the CMP apparatus of claim 10, wherein the controller further comprises a main controller configured to control the plurality of controllers.

12. The polishing head of the CMP apparatus of claim 1, further comprising a main actuator configured to rotate the distribution block with respect to the vertical direction.

13. A polishing head of a chemical mechanical polishing (CMP) apparatus comprising:

a head block configured to be positioned over a substrate;

a distribution block rotatably connected to a lower surface of the head block with respect to a vertical direction, the distribution block including a plurality of pressure lines configured to provide a working fluid flowing therethrough;

a main actuator configured to rotate the distribution block with respect to the vertical direction;

a head module connected to the lower surface of the distribution block and configured to rotate with respect to the vertical direction together with the distribution block, the head module configured to locally pressurize the substrate using the working fluid provided through the plurality of pressure lines; and a controller configured to independently control pressures of the working fluid provided to the head module through each of the plurality of pressure lines, wherein the head module comprises:

a gimbal shaft connected to a central portion of the lower surface of the distribution block; and a plurality of segmentation type heads around the gimbal shaft and connected to the distribution block, the plurality of segmentation type heads configured to be moved independently with respect to the distribution block along the vertical direction, wherein at least one kerf is between the plurality of segmentation type heads along a radial direction of the gimbal shaft.

14. The polishing head of the CMP apparatus of claim 13, wherein the head module comprises a single integral head connected to the distribution block, and the single integral head is configured to be moved independently upon the distribution block along the vertical direction.

15. The polishing head of the CMP apparatus of claim 13, wherein the head module comprises:

a plurality of actuators connected to the plurality of pressure lines to independently operate the plurality of segmentation type heads.

16. A segmentation type head module of a chemical mechanical polishing (CMP) apparatus comprising:

a gimbal shaft configured to receive a rotary force for rotating a substrate with respect to a vertical direction; and a plurality of segmentation type heads connected to the gimbal shaft, the plurality of segmentation type heads configured to be moved independently with respect to the gimbal shaft along the vertical direction, wherein the gimbal shaft comprises a plurality of gimbal portions independently connected to the plurality of segmentation type heads.

17. The segmentation type head module of the CMP apparatus of claim 16, further comprising a plurality of actuators independently operating the plurality of segmentation type heads.

* * * * *